US008094866B1

(12) United States Patent
Finegan

(10) Patent No.: US 8,094,866 B1
(45) Date of Patent: Jan. 10, 2012

(54) LOUDSPEAKER WITHOUT EXTRANEOUS CONE FORCES DUE TO AIR TRAPPED BEHIND THE DUST COVER

(76) Inventor: Joel Dean Finegan, Rockford, IL (US)

( * ) Notice: Subject to any disclaimer, the term of this patent is extended or adjusted under 35 U.S.C. 154(b) by 0 days.

(21) Appl. No.: 12/928,696

(22) Filed: Dec. 17, 2010

Related U.S. Application Data

(60) Provisional application No. 61/399,612, filed on Jul. 15, 2010.

(51) Int. Cl.
*H04R 1/00* (2006.01)
*H04R 9/06* (2006.01)

(52) U.S. Cl. ..... 381/404; 381/397

(58) Field of Classification Search ..... 381/397, 381/404

See application file for complete search history.

(56) References Cited

U.S. PATENT DOCUMENTS 6,837,333 B2 * 1/2005 Howze ..... 381/397
7,324,659 B2 * 1/2008 Funahashi et al. ..... 381/404
7,366,318 B2 * 4/2008 Nevill ..... 381/404

OTHER PUBLICATIONS

Leo L. Beranek, Acoustics, 1954, pp. 226 and 244, McGraw-Hill, N Y, U S A.

* cited by examiner

*Primary Examiner* — Brian Ensey

(57) ABSTRACT

A loudspeaker in which the cone contains holes which allows the air behind the dust cover to flow freely in and out from behind the dust cover as the cone moves. There may also be a hole or holes in the lower suspension to allow air to escape from behind the lower suspension without ever becoming turbulent. All edges on the cone and basket are to be rounded as much as economically possible to prevent the air flow from becoming turbulent. The back of the speaker should be wrapped in a cloth like nylon tulle to prevent magnetic particles from getting into the magnetic structure causing speaker failure.

3 Claims, 2 Drawing Sheets

LOUDSPEAKER WITHOUT EXTRANEOUS CONE FORCES DUE TO AIR TRAPPED BEHIND THE DUST COVER

CROSS REFERENCE TO RELATED APPLICATIONS

This application claims the benefit of U.S. Provisional Patent Application No. 61/399,612, filed on Jul. 15, 2010 which is incorporated by reference herein.

FIELD OF THE INVENTION

The present invention relates to most if not all loudspeakers incorporating a cone as the radiating surface. More particularly, the invention relates to loudspeakers in which air is trapped behind a dust cover requiring that most of the trapped air must move between the voice coil and the magnet as the cone moves.

BACKGROUND OF THE INVENTION

Over the years the recording industry has strived for perfection but until very recently has come up short of its goal. Even in the old master recordings there is a fuzziness present that was not mitigated by the use of Dolby or multi channel recording techniques. Now with the use of high resolution digital techniques perfection is being approached. A good example of this is REFERENCE RECORDINGS RR-117 Lincolnshire Posy by Percy Grainger. It should be pointed out that the use of modern digital processing on the old master recordings still retains the totally unacceptable fuzziness. This technique has been widely practiced in the last 20 or so years with the result that there is a large number of unacceptable classical discs being sold even today.

If a recording is done correctly there is music content in each channel without distortion or noise. For material that is imaged between the speakers there must be musical material that is identical but generally at different levels in the two channels. The only exception to this is for imaging midway between the loudspeakers, in which case the signal level in the two channels is identical. If such a signal is presented to the system and then amplified at very low distortion, it remains for the loudspeakers to create an acoustical environment that preserves the original sound quality.

A way in which the conventional speaker is inadequate is that the air that must pass between the voice coil and the magnet has so little room that the velocity of the air flow becomes high and turbulent even for relatively low sound levels. This leads to a back pressure that presents twice on the dust cover for every cycle. The cone motion is influenced by this back pressure with two bad effects. First, at low frequencies where the cone motion is greatest, the back pressure is great enough to seriously limit the motion of the cone and thereby limit the base response. Secondly, a great deal of noise is generated due to the turbulence with the result that the sound signal contains much noise even when the driving electrical signal is of the highest quality.

An additional problem with the conventional loudspeaker is that air trapped behind the lower suspension is also a source of turbulence which must be dealt with.

SUMMARY OF THE INVENTION

This invention incorporates vent holes in the cone behind the dust cover so that there is no force on the cone due to pressure build up on the dust cover. With the presence of the vent holes behind the dust cover there is no force mechanism that restricts the motion of the cone other than the compression of the air trapped in the box. This enables the full motion the cone that is required to produce the base notes, other than the effect of the low frequency resonance of the system. It should be noted that response of the mounted speaker falls off below the system resonance at a rate of 12 db per octave for a closed box and 18 db per octave for a vented box. This means that the low frequency response of a loudspeaker in all cases extends to slightly below the system resonance. In the conventional speaker the base response is further limited by the flow of air around the voice coil producing backpressure on the dust cover and much less realistic base response. Where this invention is incorporated the resulting response leads to really awesome base.

In the conventional speaker the air trapped behind the dust cover rushes in and out with each cycle along the path defined by the voice coil and the magnet achieving turbulent flow velocities even at low sound levels. Part of the time the flow is turbulent and part of the time the flow is non-turbulent. When the flow becomes turbulent it takes a higher pressure to maintain the flow rate and the back pressure on the dust cover varies accordingly. This contributes to an arbitrarily varying restoring force that adds to the distortion and noise of the loudspeaker. There is also distortion and noise being generated by air flow through the lower suspension. As a result in the conventional loudspeaker there is noise coming from each speaker that has no counterpart from the other speaker. As a result much of the stereo imaging is destroyed. In a loudspeaker made according to this invention most of this noise is avoided with the result that virtually all of the sound coming from one speaker has a matching sound component coming from the other speaker which leads to very much enhanced stereo imaging.

DETAILED DESCRIPTION OF THE INVENTION

Figure 1:
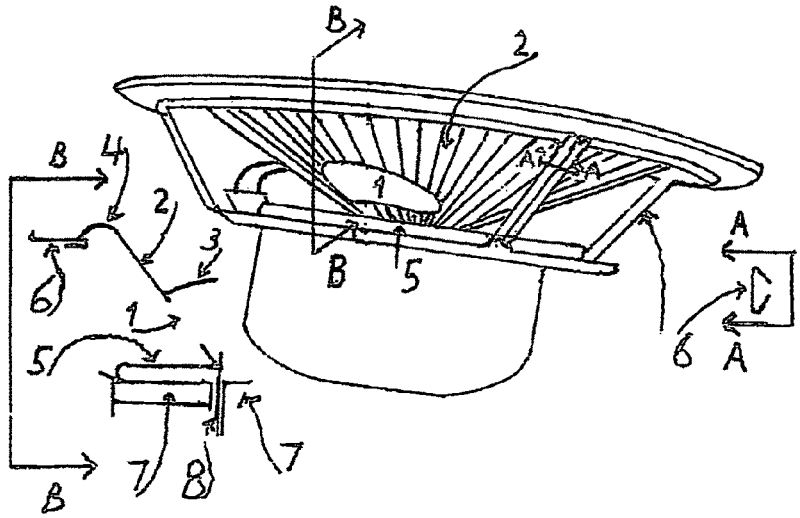
FIG. 1 is a cut away view of a loudspeaker made according to our invention. For clarity it also includes two cross sectional cuts of two of the elements of the speaker. The hole or holes in the lower suspension are not depicted.

Our invention consists of a loudspeaker with one or more sections of the cone removed to allow the air behind the dust cover to escape at a low enough velocity to assure laminar air flow at all times. There is also a hole placed in the lower suspension to avoid non laminar flow. In a conventional loud speaker a cone undergoing an excursion of ¼ inch at 50 cps attains a peak velocity of + or −6.5 feet per second each cycle. The air behind the dust cover would have to flow in and out around the voice coil at 100 or more times this velocity. Long before this can happen the flow becomes turbulent with an abrupt increase in the resistance to flow twice each cycle. This has led to distortion which we have just learned to live with since day one. Actually the subject of flow in a loudspeaker is very complex and would defy calculation. The best design approach is to keep the flow path as wide as possible and to avoid flow around sharp edges. FIG. 1 is an example of a speaker which would accomplish this.

Where 1 is a hole in the cone that allows the air behind the dust cover to flow freely without a buildup of pressure that restricts the motion of the cone. 2 is the cone. 3 is the dust cover. 4 is the outer cone suspension. 5 is the inner, lower, cone suspension. 6 is the speaker basket or frame. 7 is the magnet structure. 8 is the voice coil.

Figure 2:
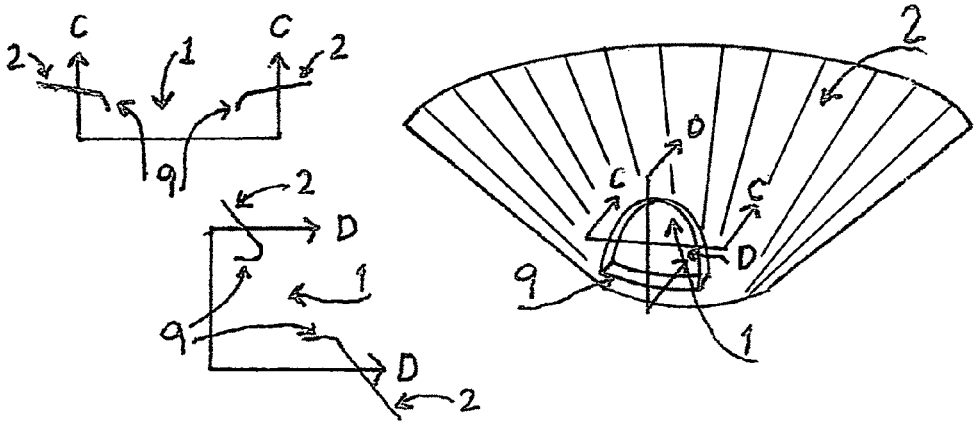
FIG. 2. shows how the hole in the cone can be modified to avoid turbulence.

It should be noted that the basket in FIG. 1 is as open as possible, without sacrificing strength, by the folded structure. The folded structure also provides soft rounded edges that allow the air to flow past without going turbulent. A further move in this direction is shown in FIG. 2 where the cone has been modified by adding the regions 9 to present rounded edges to the air flowing through the hole. It should be noted that the protrusions around the hole could be inward in the opposite direction with the same result.

Figure 3:
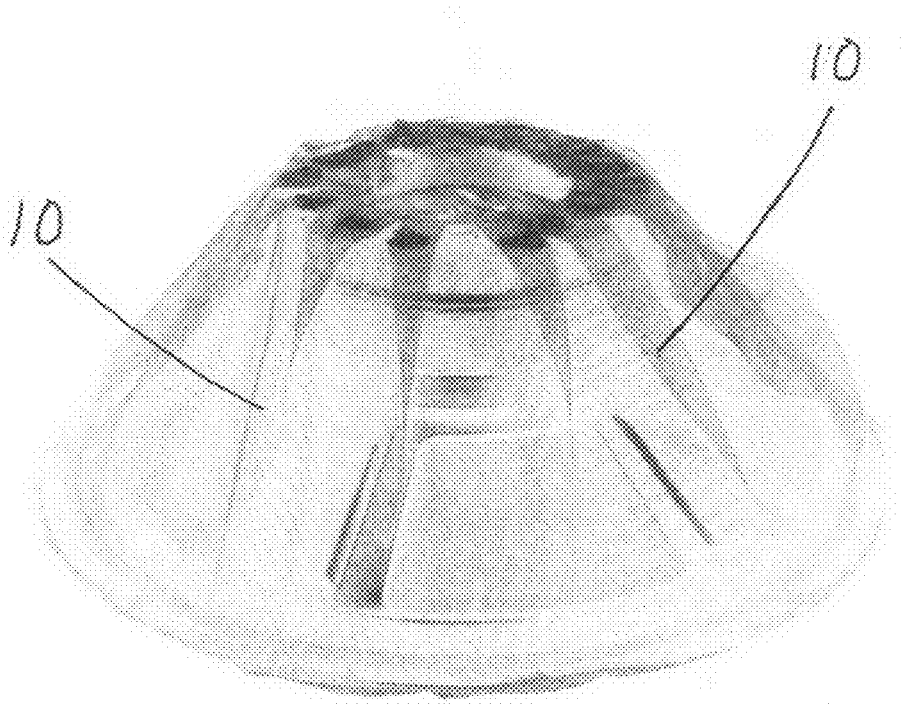
FIG. 3 shows how the back side of the speaker can be protected with a piece of gossamer cloth to keep magnetic particles out of the magnetic gap without impeding the motion of the cone.

FIG. 3 With the hole in the cone, there is always the possibility that a magnetic particle could get into the voice coil gap and interfere with the free motion of the cone. To prevent this the back of the speaker can be wrapped with a cloth of nylon tulle, which is very light in weight and has holes that are very small, but which is never-the-less very open. Region 10 shows the tulle extended over the back of a speaker. The tulle can be attached to the edge of the speaker basket with double sticky tape or glue. The tulle can be overlapped but without being fastened to itself. The tulle can be fastened to the magnet with glue, double sticky tape, or be tied to the magnet with a piece of string. FIG. 3 is actually a photograph of the tulle over the back of a speaker. The photograph shows the speaker geometry through the tulle.

What is claimed is:

1. A loudspeaker comprising: a cone; a dust cover; an outer cone suspension; an inner cone suspension; a basket; a voice coil; and a magnet structure; wherein said cone further comprises one or more holes located in said cone behind said dust cover to allow the free flow of air that would otherwise be substantially trapped and have to flow out along the very narrow path between said voice coil and said magnet structure; wherein said one or more holes in said cone further comprises rounded edges so as to present a smooth path to the flow of air past said rounded edges in said cone; and wherein said basket further comprises a folded structure having soft, rounded edges that allows air to flow past without becoming turbulent.

2. A loudspeaker as set forth in claim 1, wherein said inner cone suspension further comprises a hole or holes to allow air to flow freely and not cause backpressure on said suspension.

3. A loudspeaker as set forth in claim 1, wherein the back of said basket is covered with a light weight cloth such as nylon tulle to prevent magnetic particles from entering into the voice coil gap with the result that the speaker fails.

* * * * *